United States Patent [19]

Pech

[11] 4,061,439

[45] Dec. 6, 1977

[54] IMPELLER PUMP AND VANE PUMP ASSEMBLY WITH CLUTCH DEACTIVATION

[75] Inventor: Karl H. Pech, Simsbury, Conn.

[73] Assignee: Chandler Evans Inc., West Hartford, Conn.

[21] Appl. No.: 700,763

[22] Filed: June 29, 1976

[51] Int. Cl.[2] ..... B27C 9/00

[52] U.S. Cl. ..... 415/18; 415/62; 415/123; 417/199 A; 192/103 A

[58] Field of Search ..... 415/18, 122 R, 123, 415/61, 62; 417/199 A; 418/69; 192/104 C, 104 R, 103 A

[56] References Cited

U.S. PATENT DOCUMENTS

| | | | |
|---|---|---|---|
| 2,432,591 | 12/1947 | Schuckers | 192/104 R |
| 2,464,144 | 3/1949 | McConaghy | 415/18 |
| 2,612,844 | 10/1952 | Grise | 417/199 A |
| 3,208,389 | 9/1965 | Stefan | 415/18 |
| 3,518,028 | 6/1970 | Minick | 417/199 A |
| 3,811,797 | 5/1974 | Lewis | 417/199 A |
| 3,851,998 | 12/1974 | Downing | 417/199 A |
| 3,941,505 | 3/1976 | Nasvytis et al. | 417/202 |
| 3,961,859 | 6/1976 | Cygnor et al. | 415/18 |

OTHER PUBLICATIONS

ASME Publication entitled Develop. of a Retracting Vane/Centrifugal Main Fuel Pump for Gas Turbine Engine, by Pech et al. 3/1976.

*Primary Examiner*—C. J. Husar

*Attorney, Agent, or Firm*—Radford W. Luther; Richard A. Dornon

[57] ABSTRACT

A fuel pump assembly for a gas turbine engine incorporates an impeller pump and a vane pump which are driven by a common drive shaft. A centrifugally operated clutch functions to disengage the vane pump from the drive shaft at a predetermined angular velocity. The vane pump is designed to fulfill dry lift, starting flow and pressure requirements for the engine. The impeller pump, alone, provides fuel to the engine near idle speed and above after the vane pump has been disengaged from the drive shaft.

5 Claims, 3 Drawing Figures

IMPELLER PUMP AND VANE PUMP ASSEMBLY WITH CLUTCH DEACTIVATION

BACKGROUND OF THE INVENTION

This invention relates to pumps and more particularly to pumping systems for gas turbine engines.

Pumping assemblies for gas turbine engines which embody an impeller pump and a vane pump in an integrated design are known in the art. For example, U.S. Pat. No. 3,851,998 shows such a combination pump with a vane pump constituted by a stationary centrally disposed cam and an annular rotor with radially inwardly directed vanes. In the pump of the patent, the vanes fly off the cam surface when a predetermined speed is attained.

A pump, such as shown in the aforementioned patent, presents numerous manufacturing and design problems. In this respect, it will be appreciated that the manufacture of inwardly facing slots in the rotor is more costly than the provision of outwardly facing slots in a standard vane pump rotor. More important, however, is the fact that the vane pump cavity must be evacuated when only the impeller pump is supplying fuel if fuel heating and power consumption are to be minimized. Heating of the engine fuel will, of course, detract from the fuel's ability to perform the assigned cooling functions without exceeding the maximum safe entrance temperature at the fuel nozzles. Also, it may be necessary to provide for withdrawal of the stationary side plates or plate in order to prevent pump damage and/or friction losses.

SUMMARY OF THE INVENTION

The invention provides an integrated pump assembly comprising a state of the art, fixed displacement vane pump and an impeller pump capable of supplying fuel to a gas turbine engine. A centrifugal clutch is provided to disconnect the vane pump from the drive shaft such that the vane pump is inactive after a certain speed is attained. After deactivation of the vane pump, the centrifugal pump continues to furnish fuel to the engine. It will be appreciated that a centrifugal clutch is advantageous in that valving is not required to apply pressure signals for engagement or disengagement. In a pump assembly of the invention, the vane pump is automatically deactivated at a predetermined unloading speed.

A salient feature of a pump assembly of the invention is the standard vane pump incorporated therein, which may be inexpensively manufactured in accordance with established procedures and does not present difficult design problems as are encountered with pumps with retracting vanes. Furthermore, when the vane pump in a pump assembly of the invention is deactivated, it obviously cannot engender heat rejection to the fuel which could impair its ability to perform as a coolant in various engine accessories.

Accordingly, it is a primary object of the invention to provide a fuel pump assembly for a gas turbine engine wherein the assembly incorporates an impeller pump and a fixed displacement vane pump which is deactivated by a centrifugal clutch after a predetermined speed is attained.

Another object is to provide an integrated pump assembly comprising an impeller pump and a vane pump wherein the vane pump is adapted to be completely deactivated at a predetermined speed, whereby the unloaded vane pump does not cause any heating of the fluid being pumped or require an expenditure of power substantially greater than that necessary to drive the impeller pump.

A further object is to provide a pump assembly, embodying an impeller pump which is continuously operating and a vane pump which unloads after a predetermined speed is achieved, in which the vane pump may be conventional in design.

These and other objects and advantages of the invention will become more readily apparent from the following detailed description, when taken in conjunction with the accompanying drawings, in which:

DETAILED DESCRIPTION OF THE PREFERRED EMBODIMENTS

Figure 1:
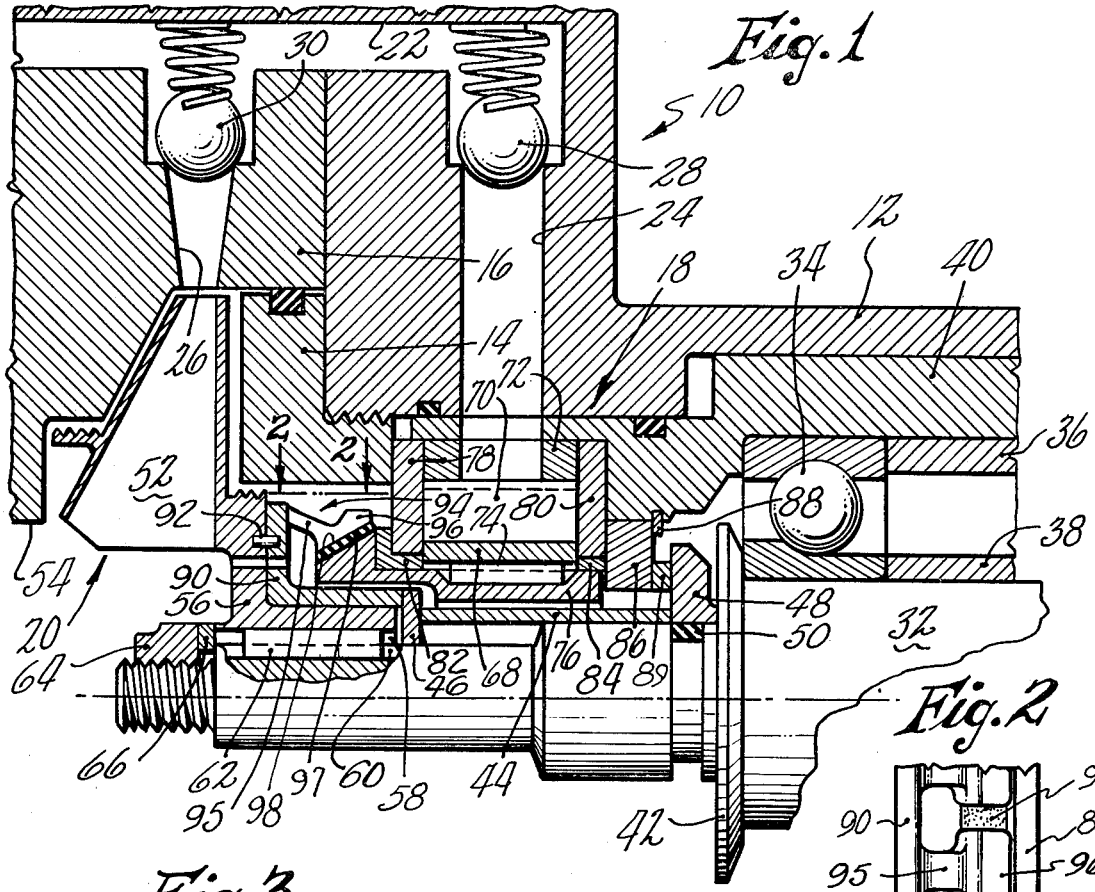
FIG. 1 is a schematic view of a first embodiment of the invention.
Figure 2:
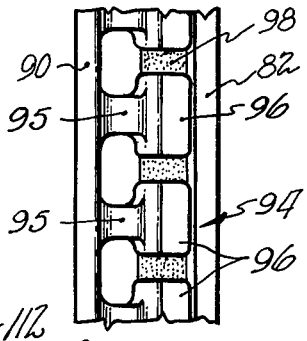
FIG. 2 is a linearized peripheral view of the clutch member taken along the line 2—2 of FIG. 1.

Referring to FIGS. 1 and 2, there is shown a first embodiment of a fuel pump assembly according to the invention which is adapted to supply fuel to a gas turbine engine (not shown). The fuel pump assembly includes a housing, generally indicated at 10, as constituted by housing portions 12, 14 and 16. A vane pump, generally shown at 18, and an impeller pump, generally shown at 20, discharge fuel to a common discharge conduit 22 via respective discharge passages 24 and 26, which are provided with check valves 28 and 30. The common discharge conduit 22 communicates with the metering valve of a fuel control (not shown).

The pumps 18 and 20 are driven by a primary drive shaft 32 which is mounted for rotation within the housing by means of two axially spaced bearings, one of which is designated 34 and the other of which is not shown. The bearings are separated in the usual manner by spacers 36 and 38 which respectively bear against the upper and lower races of the bearings. A bearing retainer 40, interposed between the bearings and the housing portion 12, serves to position the outer races of the bearings, while a flange 42, on the primary drive shaft 32, positions the inner race of the bearing 34 and preloads the entire bearing assembly. It should be noted that the flange 42 also acts as a slinger to sling oil out of the bearing 34. Urged against the flange 42 by spacers 44 and 46 is a seal face 48, the inner annular surface of which bears against an Oring seal 50 seated in an annular recess in the drive shaft 32. A carbon faced seal 86 fixedly mounted in housing portion 12 has its face in wiping engagement with the front facing transverse surface of the seal face 48 for preventing fuel from leaking into the bearing assembly.

The impeller pump 20 (which may be a vapor core pump with inlet throttling) has an impeller element 52 mounted within a cavity within the housing 10. Fuel proceeds to the eye of the impeller element 52 through an inlet conduit 54 in housing portion 16. The hub 56 of the impeller element 52 has an axially extending recess 58 which confronts a similar axially extending recess 60 in the drive shaft 32. A key 62 is inserted into the recesses 58 and 60, thereby securing the impeller 52 to the drive shaft for rotation therewith. It will be seen that the left or front end of the drive shaft 32 is threaded and that a nut 64 and washer 66 are secured thereupon, whereby the key 62 is retained in the recesses 58 and 60.

The vane pump, 18 which is highly conventional in design, comprises a slotted rotor 68 having a plurality of radially movable vanes 70 inserted in the slots thereof. The radially outer surfaces of the vanes 70 are in engagement with the inner surface of a cam member 72 for travel thereover which produces the usual inward and outward vane movement. Perferably, pump 18 will be provided with two diametrically opposed radial outlets and two diametrically opposed radial inlets, whereby the rotor will be pressure balanced. From FIG. 1, it will be noted that the interior wall of the rotor 68 is slotted to receive a key 74 which is also received in a confronting slot on the outer periphery of a secondary drive shaft 76, whereby a driving interconnection is established between the rotor 68 and the secondary drive shaft 76.

Pump 18 is provided with annular side plates 78 and 80, the inboard surfaces of which rest against the ends of the rotor, vanes and cam member. The outer peripheries of the side plates 78 and 80 are seated upon an inner wall of the bearing retainer 40; and the inner peripheries thereof are seated upon a stationary bearing 82 (press fitted and pinned into side plate 78) and a bearing 84 (pressed into the side plate 80). The bearings 82 and 84 and the side plates 78 and 80 are stationary structures, as is a carbon faced seal 86, the latter being retained against side plate 80 by a snap ring 88 such that the spring loaded seal 89 thereof engages seal face 48 to prevent fuel from leaking into the bearing assembly. When the secondary drive shaft 76 is rotated, such motion is guided by the bearings 82 and 84 as the outer surface of the secondary drive shaft 76 slides thereover.

A clutch member 90, secured to the hub 56 of the impeller 52 by means of dowels 92, has a plurality of rearwardly and radially inwardly projecting, circumferentially distributed, fingers 94 formed integral therewith. Each finger is constituted by a flexible spring arm 95 which terminates in a pad 96. The fingers 94, which are adapted to flex outwardly in response to centrifugal forces acting on the pads 96 when a predetermined speed is attained, each have a friction engagement surface 97 on the undersides thereof which is adapted to engage an annular friction engagement surface 98 on the drive shaft 76.

In operation, as shaft 32 begins to turn, the vane pump causes a sufficient pressure increase in passage 24, whereby check valve 28 cracks open and flow is discharged through passage 24 to the common discharge conduit 22. Valve 30, which remains closed while vane pump 18 is operating (due to higher pressure in conduit 22 than in passage 24), blocks discharge of fluid from impeller pump 20 which, of course, always operates when shaft 32 is turning. With the passage 26 blocked, the operating impeller pump only produces minor fuel heating at speeds below the deactivation speed of the vane pump. As will be appreciated from FIG. 1, torque is transmitted to the vane pump rotor 68 via the clutch member 90 and the secondary drive shaft 76, torque being transmitted between the latter elements by the engagement of the friction surfaces 97 and 98.

As the RPM of the drive shaft 32 increases, the speed at which the friction surface 97 will lift off the friction surface 98 is approached. This may be somewhere near the idle speed of the engine (e.g., 50%). At this point, some slipping is occasioned between the friction surfaces 97 and 98. The slippage progressively increases until the surfaces 97 and 98 are completely out of engagement. For a brief period during clutch disengagement, the pressure output of the vane pump will decrease (due to clutch slippage) to such an extent that check valve 30 will crack open, whereby the vane pump 18 and the impeller pump 20 will simultaneously supply fuel to the common discharge conduit 22.

As the surfaces 97 and 98 separate, the discharge pressure of the vane pump 18 will drop to inlet pressure whereby the pressure in conduit 22, generated by the impeller pump, will cause the check valve 28 to close. Fuel to the engine is thereafter supplied solely by the impeller pump 18 and rotor 68 is idle.

Figure 3:
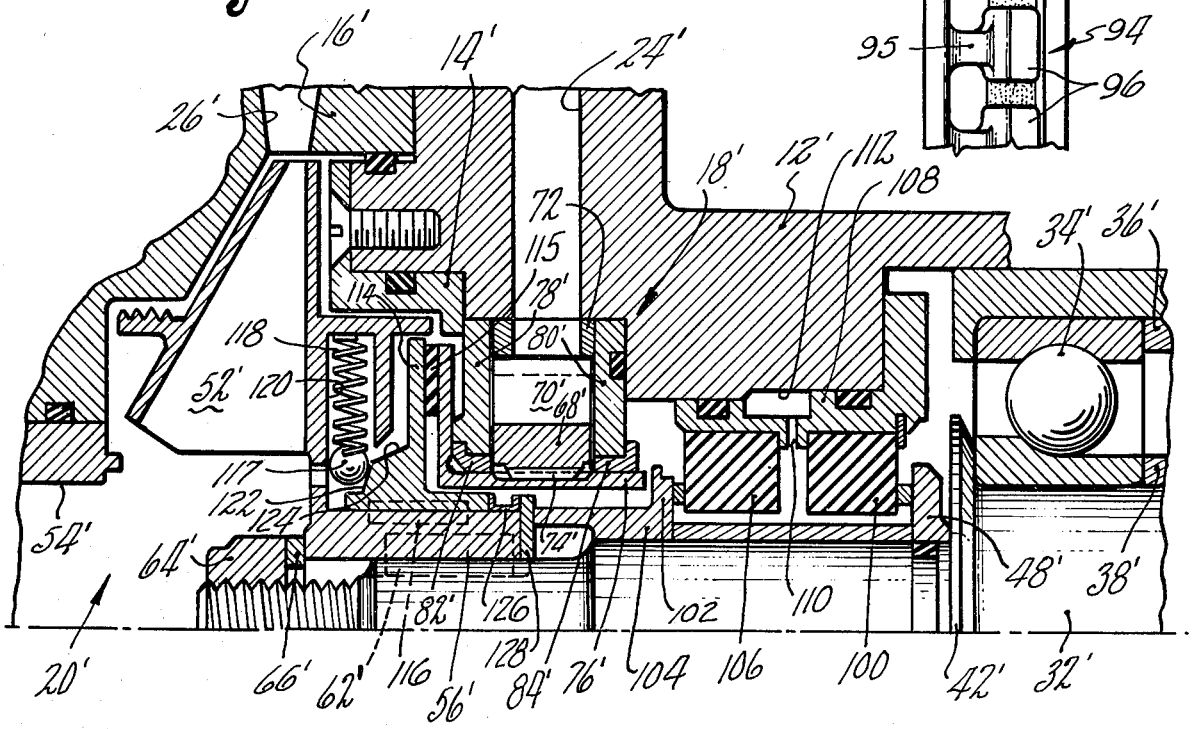
FIG. 3 is a schematic view of a second embodiment of the invention.

Turning now to FIG. 3, wherein elements similar to those of FIG. 1, which will not be discussed for the sake of brevity, are designated by like primed numerals, there is depicted a second embodiment of the invention, distinguishable from the first embodiment in that it incorporates a different form of clutch assembly. In addition, there are certain minor structural differences which will now be described. From FIG. 2, it will be seen that the seal face 48' engages the spring loaded sealing element of a carbon faced seal 100 and that a seal face 102 of a seal spacer 104 engages the spring loaded sealing element of another tandemly arranged carbon faced seal 106. The carbon faced seals 100 and 106 are positioned by a seal retainer 108, which includes a passage 110 to enable trapped fuel to proceed to an overboard drain (not shown) in communication with the cavity 112. Radially inwardly of the carbon faced seals 100 and 106, a cylindrical spacer is provided to establish the required spacing between the seal faces 48' and 102. In addition, the rotor 68' has a plurality of internal splines 74' fashioned thereupon which are received in the voids between the external splines on the secondary drive shaft 76' such that a driving interconnection is established therebetween.

The clutch assembly of FIG. 3, while centrifugally operated in the manner of that of FIG. 1, is of a modified form. An axially movable vane drive plate 114, having a longitudinally extending recess which confronts a similar recess in the impeller hub 56', is secured to impeller hub for rotation therewith by a key 116 inserted in the confronting recesses. When urged to the right, a friction surface on the drive plate 114 engages an annular friction disc 115 which is fixedly mounted upon the drive shaft 76' so as to form a part thereof. Drive plate 114 is urged to the right by a plurality of balls 117 which are each loaded a spring 118. The spring and ball combinations are respectively mounted in a plurality of radial cavities 120 in impeller 52'.

It will be noted that the vane drive plate embodies a first annular cam surface 122 and a second annular cam surface 124 and that the first cam surface is steeper than the second cam surface. The underlying rationale for having differing slopes is that complete disengagement between the vane drive plate and friction disc 115 is facilitated. After the balls 116 move radially outwardly of the line of demarcation between the cam surfaces, leftward movement of the vane drive plate 114 is accelerated, thereby contributing to rapid complete disengagement. Leftward movement of the drive plate 114 is urged by a wave spring 126 (together with a slight fluid pressure differential thereacross) interposed between the drive plate 114 and a spacer 128 which is disposed between the seal spacer 104 and the impeller hub 56'.

In operation, up to slightly below idle speed, for example, the balls 117 urged the vane drive plate 114 to the right such that it engages the friction disc 115, whereby the vane pump 18' and the impeller pump 20' operate in unison. As disengagement RPM is approached, the balls 117 begin to move radially outwardly, compressing their associated springs 118. The vane drive plate 114 simultaneously moves to the left a distance not quite sufficient to effect disengagement because of deflections in the engaged vane drive plate 114 and drive shaft 76'. As the engine RPM further increases, the balls 117 move further outwardly clearing the line of demarcation between the surfaces 122 and 124, thereby permitting rapid leftward movement of the vane drive plate under the urging of the wave spring 128 and the pressure differential thereacross. When the RPM (and hence centrifugal force on balls 117) is sufficiently reduced, the horizontal component of the force of the balls 117 acting on the surface 124 will drive the drive plate to the right against the bias of the wave spring 126. After the balls 117 clear the line of demarcation between the surfaces 122 and 124, contact between the surface 122 and the balls 117 will urge the drive plate 114 into the firm re-engagement with the friction disc 115.

Obviously, many modifications and variations are possible in light of the above teachings without departing from the scope and spirit of the invention, as set forth in the claims.

I claim:

1. A fuel pump assembly for a gas turbine engine comprising:

a pump housing;

a primary drive shaft mounted for rotation within the housing;

an impeller mounted upon the drive shaft in driving connection therewith such that rotation of the primary drive shaft produces a corresponding rotation of the impeller;

a rotor having a plurality of slots therein mounted in the housing in encircling coaxial relationship to the primary drive shaft;

a plurality of radially movable vanes positioned in the slots;

a cam member mounted in the housing for engaging the radially outer surfaces of the vanes during rotation of the rotor for producing radially inward and outward vane movements;

a secondary drive shaft at least partially disposed between the primary drive shaft and the rotor in driving connection with the rotor such that rotation of the secondary drive shaft produces a corresponding rotation of the rotor;

means to engage the secondary drive shaft to drivingly interconnect the impeller and the secondary drive shaft;

spring means to bias the engaging means into contact with the secondary drive shaft; and means urged radially outwardly by centrifugal force to progressively counter the bias of the spring means as the primary shaft speed increases and allow disengagement of the engaging means from the secondary drive shaft at a predetermined speed of the primary drive shaft.

2. A fuel pump assembly, as defined in claim 1, wherein the engaging means comprises:

a friction surface; and wherein the spring means comprises:

a flexible spring arm mounted upon the impeller for rotation therewith; and wherein the radially urged means comprises:

a pad connected to the spring arm, the friction surface being constituted by the surface of the pad.

3. A fuel pump assembly, as defined in claim 1, wherein the engaging means comprises:

a vane drive plate, having a cam surface, mounted upon the impeller for rotation therewith and axial sliding movement thereover; and wherein the spring means comprises:

a radially extending compression spring mounted in the impeller; and wherein the radially urged means comprises:

a ball seated upon the radially inner end of the compression spring, the ball being spring urged into engagement with the cam surface for urging the vane drive plate into the secondary drive shaft below the predetermined speed and being adapted to clear the cam surface slightly below the predetermined speed to facilitate axial movement of the vane drive plate in the direction away from the secondary drive shaft.

4. A fuel pump assembly, as defined in claim 3, further including:

resilient means to urge the vane drive plate away from the secondary drive shaft.

5. A fuel pump assembly, as defined in claim 3, wherein the vane drive plate further comprises:

another cam surface adjacent the first mentioned cam surface and adapted to engage the ball after it clears the first mentioned cam surface, the second mentioned cam surface not being as steep as the first mentioned cam surface to facilitate disengagement.

* * * * *